United States Patent [19]

Ishida

[11] 4,324,071

[45] Apr. 13, 1982

[54] DUAL WINDOW ASSEMBLY

[75] Inventor: Kinji Ishida, Toyama, Japan

[73] Assignee: Yosnida Kogyo K.K., Tokyo, Japan

[21] Appl. No.: 71,114

[22] Filed: Aug. 30, 1979

[30] Foreign Application Priority Data

Sep. 12, 1978 [JP] Japan ..... 53-124990
Oct. 13, 1978 [JP] Japan ..... 53-140375

[51] Int. Cl.[3] ..... E06B 7/00
[52] U.S. Cl. ..... 49/63; 49/DIG. 1
[58] Field of Search ..... 49/63, 61, DIG. 1, 64, 49/67, 504, 505; 52/212

[56] References Cited

U.S. PATENT DOCUMENTS 2,136,273 11/1938 Chaffee et al. ..... 52/212
2,311,300 2/1943 Dubour et al. ..... 49/64 X
2,703,158 3/1955 Hauck ..... 49/63
2,773,571 12/1956 Kelly ..... 52/212
2,970,642 2/1961 Parsons ..... 49/63 X
3,273,287 9/1966 Pease, Jr. ..... 49/468
3,436,884 8/1969 Bell et al. ..... 49/504 X
3,694,961 10/1972 Johnson ..... 49/505 X
4,048,774 9/1977 Yamamoto ..... 49/63 X

*Primary Examiner*—Philip C. Kannan
*Attorney, Agent, or Firm*—Hill, Van Santen, Steadman, Chiara & Simpson

[57] ABSTRACT

A dual window assembly comprises an interior window unit adapted to be mounted within an opening in a building wall and an exterior window unit adapted to be mounted on the exterior of the opening. First and Second frames of the units have respective first and second mounting flanges which are interconnected by means of connector plates.

11 Claims, 11 Drawing Figures

DUAL WINDOW ASSEMBLY

BACKGROUND OF THE INVENTION

1. Field of the Invention

This invention relates to a dual window unit, and more particularly a dual window unit construction providing a unit for use in combination with an existing unit disposed in an opening in a building wall.

2. Prior Art

The type of exterior window units with which this invention is concerned provides a high degree of thermal insulation, air-tightness and sound insulation since the units are mounted on the outside of openings in building walls, in which openings other window assemblies have been previously installed.

When installing new exterior window units in combination with existing interior window units, it was required to reconstruct or break down the exterior sidings of the building walls or some of the frame members of the existing interior window units. Considerable difficulty was also experienced in mounting the vertical frames or jambs of the new units in cases where the exterior building walls vary in thickness, and thus the installation work was time-consuming and tedious.

SUMMARY OF THE INVENTION

It is therefore a primary object of the invention to provide an exterior window having means for facilitating the installation thereof in combination with an existing interior window unit without remodeling or impairing the exterior building walls within which the existing interior window unit is present.

Another object of the invention is to provide a connector plate which can be mounted firmly on the interior window frame in the building wall with maximum ease.

According to the present invention, there is provided a dual window assembly for covering an opening in a building wall having an exterior siding. The dual window assembly comprises: an interior window unit adapted to be mounted within the opening and to be disposed on the interior of the exterior siding, said interior window unit including a first frame and a first pair of sashes mounted within said first frame, said first frame having a first mounting means; an exterior window unit adapted to be mounted on the exterior of the building wall, said exterior window unit including a second frame for extending beyond the thickness of the exterior siding, and a second pair of sashes mounted within said second frame, said second frame having a second mounting means; a connector plate interconnecting said second frame with said first frame, said connector plate including a pair of first and second sections secured to said first and second mounting means, respectively; and means on said first section of said connector plate engaging said first mounting means.

Many other advantages, features and additional objects of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE PREFERRED EMBODIMENTS

Figure 1:
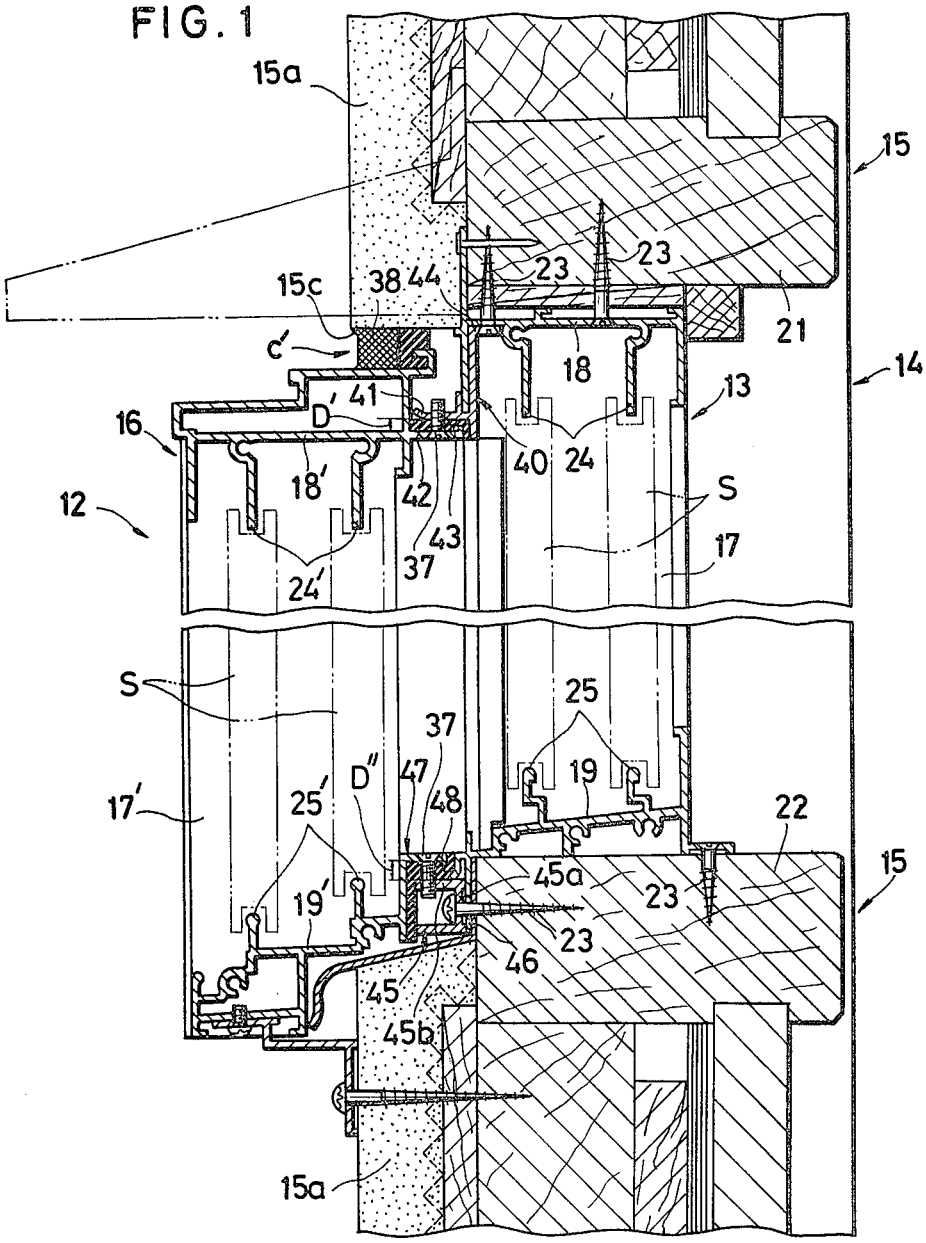
FIG. 1 is a vertical cross-sectional view through a dual window assembly having a connector plate provided in accordance with the invention.
Figure 2:
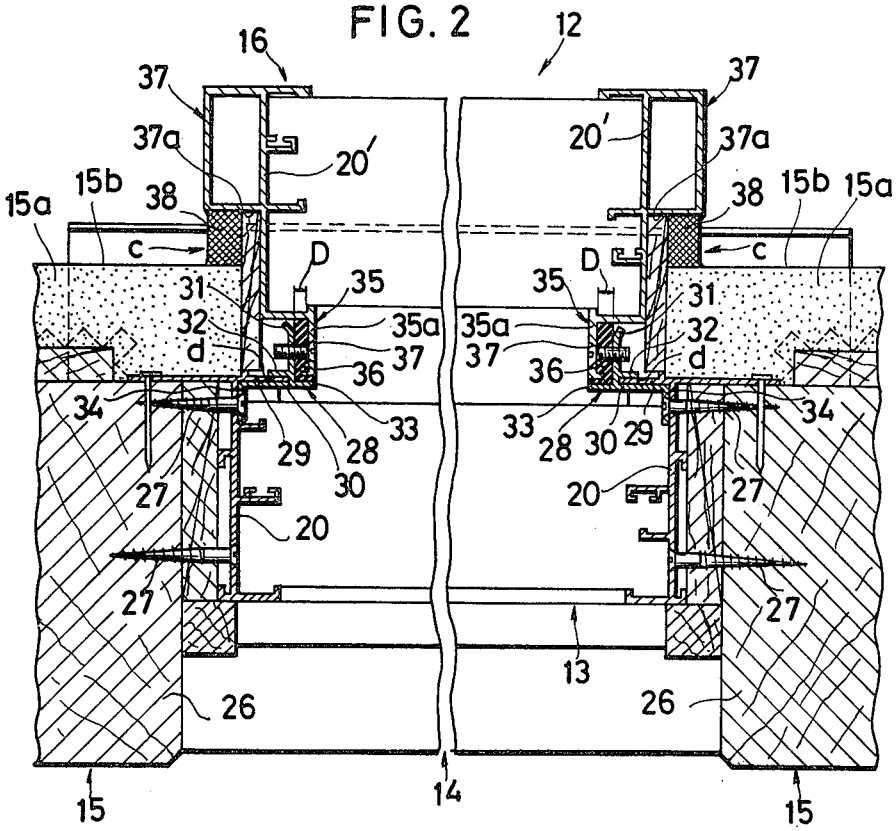
FIG. 2 is a horizontal cross-sectional view through the assembly of FIG. 1.

FIGS. 1 and 2 show a dual window assembly 12 which comprises an interior window unit 13 mounted within and covering an opening 14 in a building wall 15 and an exterior window unit 16 mounted on the exterior of the building wall 15 and interconnected with the interior window unit 13 in the manner described below. The building wall 15 has an exterior siding 15*a*.

For the best advantage of the invention, the interior window unit 13 is considered to have been previously installed or already existing at the time the exterior window unit 16 is installed. The interior window unit 13 broadly comprises a frame 17 made preferably of extruded aluminum and including a pair of horizontally extending header and sill members 18,19 (FIG. 1) and a pair of vertical frame members or jambs 20,20 (FIG. 2) interconnecting the header 18 and the sill 19 at their opposite ends, respectively, to define a generally rectangular opening within which a pair of relatively movable sashes S,S of the rolling type is mounted in parallel closely spaced planes for horizontal rolling movement on the sill 19.

The header and sill members 18,19 of the interior window unit 13 are fixed to a pair of upper and lower wooden support blocks 21,22, respectively, of the building wall 15 by a number of wood screws 23, as shown in FIG. 1. The frame 17 has a pair of parallel spaced, downwardly extending flanges 24,24 formed integrally with the header 18, and a pair of upwardly extending flanges 25,25 formed integrally with the sill 19, the flanges 24 on the header 18 cooperating with those on the sill 19 for supporting the sashes S in the manner discussed above. The jambs 20,20 are fixed to a pair of side wooden support blocks 26,26, respectively, of the building wall 15 by a number of wood screws 27, as shown in FIG. 2.

The exterior window unit 16, detailed below, may be partially identical in construction to the interior window unit 13 and hence is identified by the same primed reference numerals for similar parts thereof.

In FIG. 2, the exterior window unit 16 is interconnected with the interior window unit 13 through their respective pairs of jambs 20,20 and 20′,20′ by means of a pair of first connector plates 28,28. Each jamb 20 of the interior window unit 13 has a first mounting flanges 29 projecting inwardly from the exterior edge of the jamb 20, thus providing an L-shaped exterior end portion of the jamb 20. The first connector plate 28 includes a base 30 in the form of an elbow complementary in shape to the L-shaped exterior end portion of the jamb 20, and a mounting fin 31 projecting exteriorly from an inwardly directed portion 33 of the base 30. The first mounting fin 31 has an outwardly directed branch 32 which extends parallel to the inwardly directed portion 33 of the base 30 and defines therewith a first spacing d for snugly receiving the inner edge of the first mounting flange 29. In other words, the branch 32 of the first mounting fin 31 and the portion 33 of the base 30 jointly provide a cross-sectionally hook-shaped portion which serves as an engaging means. An interiorly directed portion 34 of the connector base 30 is fixed to the jamb 20 of the interior window unit 13 by some of the wood screws 27 respectively extending through the portion 34 of the base 30 and the jamb 20 into one of the side support blocks 26 of the building wall 15. Thus, the connector plate 28 is fixed to the jamb 20 of the interior window unit 13.

The jambs 20' of the exterior window unit 16 each have a second mounting flange 35, cross-sectionally L-shaped, of which an interiorly directed portion 35*a* extends parallel to the mounting fin 31 of the first connector plate 28 and defines therewith a second spacing D for receiving a sealing strip or gasket 36, made preferably of polyvinylchloride and serving as a thermal insulator. A number of headed screws 37, only one of which is illustrated here, pass through the portion 35*a* of the second mounting flange 35, through the sealing strip 36 and through the mounting fin 31 of the connector plate 28, and thus secures these parts together, establishing a connection between the interior and exterior window units 13,16.

Along its exterior edge, each jamb 20' of the exterior window unit 16 has an outwardly projecting hollow flange 37 of which an interior portion 37*a* extends parallel to the exterior surface 15*b* of the exterior siding 15*a* of the building wall 15 and defines therewith a first clearance c which may vary with the thickness of the siding 15*a* of the building wall. The clearance c is filled with a suitable sealing material 38 such as a caulking compound. A second clearance c, which communicates all around the outer periphery of the exterior window frame 17', is likewise filled up with the caulking compound 38, and lies between the lower surface 15*c* of the upper portion of the wall siding 15*a* and the header 18' of the exterior window unit 16, as shown in FIG. 1. Alternatively, the sealing material 38 may further include a sealing strip made preferably of polyvinylchloride, effecting an increased degree of thermal insulation.

There is shown in FIG. 1 a second connector plate 40 similar to the first connector plates 28 of FIG. 2 and adapted to interconnect the exterior window unit 16 with the interior window unit 13, in which instance a second mounting fin 41 integral with the second connector plate 40 extends horizontally parallel to an interiorly directed mounting flange 42 on the header 18' of the exterior window frame 17' and defines therewith a third spacing D' for receiving a sealing strip or gasket 43, made preferably of polyvinylchloride and serving as a thermal insulator. A number of headed screws 37, only one of which is illustrated here, pass through the mounting flange 42, through the sealing strip 43 and through the mounting fin 41 of the second connector plate 40, and thus secures these parts together. Some of the wood screws 23 extend through an interior directed portion 44 of the second connector plate 40 and the header 18 of the interior window frame 17 into the upper support block 21, and thus the second connector plate 40 is connected securely to the header 18 of the interior window frame 17.

A third connector 45 is provided for interconnecting the sill 19' of the exterior window 16 with the sill 19 of the interior window unit 13. The third connector 45 has a generally U-shaped cross section of which a base portion 45*a* is fixed to an outwardly directed mounting flange 46 of the sill 19 by some of the wood screws 23. An L-shaped mounting flange 47 of the sill 19' is fixed by a number of headed screws 37 (only one of which is illustrated here) to one of leg portions 45*b* of the "U". The leg portion 45*b* serves as a mounting fin. The mounting flange 47 defines with the mounting fin 45*b* a third spacing D" for snugly receiving a sealing strip 48 made preferably of polyvinylchloride.

When the exterior window unit 16 is to be installed, each of the two first connector plates 28 is interfitted with one of the jambs 20 of the interior window unit 13 so as to snugly receive the inner edge of the first mounting flange 29 of said one jamb 20 between the portion 33 of the base 30 and the branch 32 of the first mounting fin 31. The connector plate 28, together with said one of the jambs 20, is then secured to the side support block 26 by a number of the wood screws 27. Likewise, the second connector plate 40 is interfitted with the header 18 of the interior window unit 13 and is, together with the header 18, secured to the upper support block 21 by a number of the wood screws 23. The third connector 45 is simply brought into abutment against the mounting flange 46 of the sill 19 of the interior window unit 13 and is, together with the last-mentioned mounting flange 46, secured to the lower support block 22 by a number of the wood screws 23. Then, the exterior window unit 16 is placed within the rectangular opening, defined by these four connector plates 28,28,40,45, such that the four mounting flanges 35,35,42,47 on the exterior window frame 17' overlap the mounting fins 31,31,41,45*b* on the four connector plates 28,28,40,45, respectively. At any time before the exterior window unit 16 is placed within that rectangular opening, the four pieces of sealing strips 36,36,43,48 have been carried on the four mounting flanges 35,35,42,47, respectively, so as to be suitably disposed in the spacings D,D,D',D" when the exterior window unit 16 is thus placed. Finally, the headed screws 37 are threaded through the individual mounting flanges 35,35,42,47 and the individual sealing strips 36,36,43,48 into the individual mounting fins 31,31,41,45*b* so as to connect the four exterior frame members 20',20',18',19' securely to the connector plates 28,28,40,45, respectively. Thus, the exterior window unit 16 can be mounted fixedly in position on the interior window unit 13.

Figure 3:
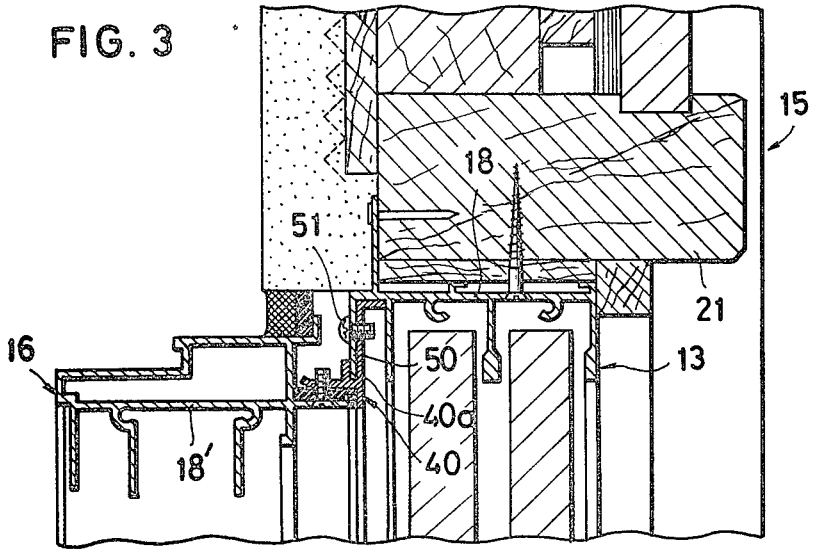

According to a second embodiment of the invention shown in FIG. 3, the second connector plate 40 is secured to a downwardly directed mounting flange 50 of the header 18 of the interior window unit 13 by a number of headed screws 51 each extending threadedly through the mounting flange 50 and an inwardly directed base portion 40*a* of the connector plate 40, in which instance the wood screws 23 may be omitted.

Figure 4:
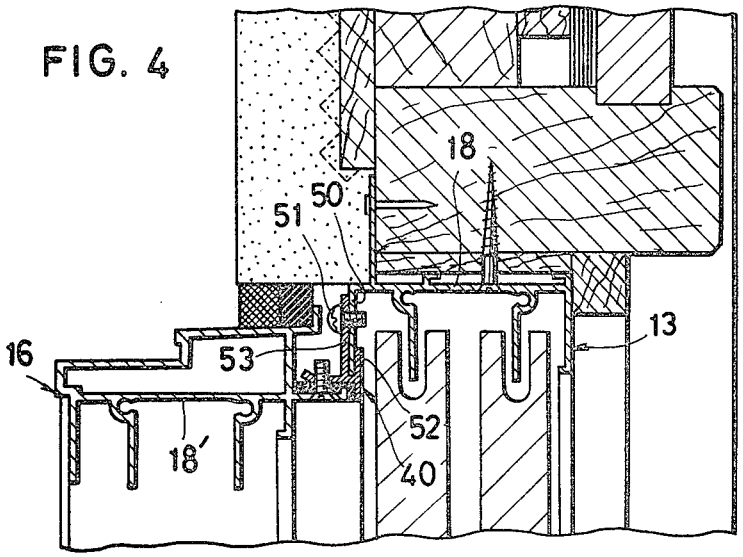

As shown in FIG. 4, a third embodiment of the invention differs from the second embodiment of FIG. 3 only in that the second connector plate 40 has a relatively short base portion 52 and a branch 53 extending upwardly beyond the base portion 52 and that the headed screws 51 each are threaded through the branch 53 and the mounting flange 50. The base portion 52 of the connector plate 40 extends toward and terminates short of the screws 51.

Figure 5:
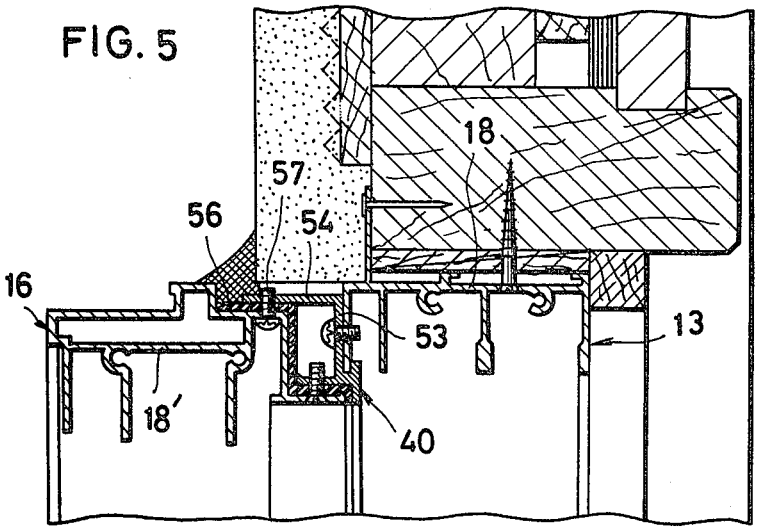

A fourth embodiment of the invention shown in FIG. 5 is similar to the third embodiment of FIG. 4 and differs therefrom only in that the second connector plate 40 further has a horizontal mounting fin 54 extending exteriorly from the upper edge of the extended branch 53 and that the mounting fin 54 is secured to the header 18′ of the exterior window unit 16 through a sealing strip 56 by a number of headed screws 57. The sealing strip 56 is an extension of the sealing strip 43 (FIG. 1), effecting an increased degree of thermal insulation.

Figure 6:
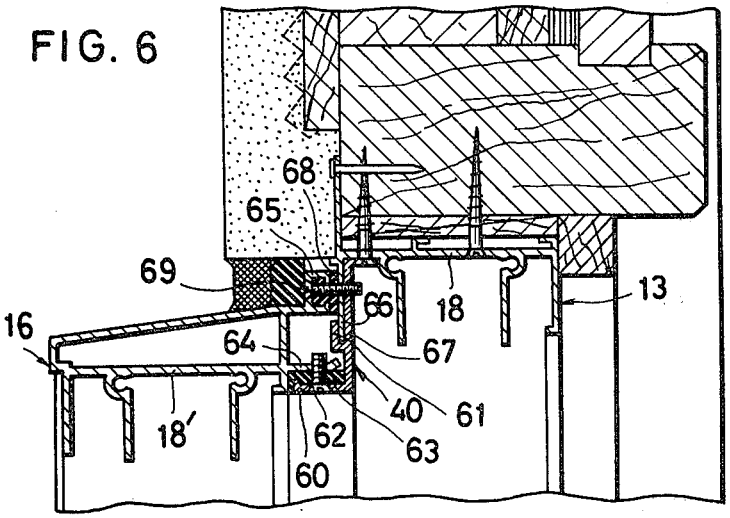

According to a fifth embodiment shown in FIG. 6, a horizontal mounting fin 60 and an engaging branch 61 on the second connector plate 40 are formed separately and are remote from each other. A first set of headed screws 62 are threaded through the mounting fin 60, a sealing strip 63, and a lower mounting flange 64 of the header 18′ of the exterior window unit 16 so as to secure these parts together. An upper mounting flange 65 of the header 18′ is secured to a downwardly directed mounting flange 66 on the header 18 of the interior window unit 13 as well as to a base portion 67 of the connector plate 40, through another sealing strip 68, by a second set of headed screws 69.

Figure 7:
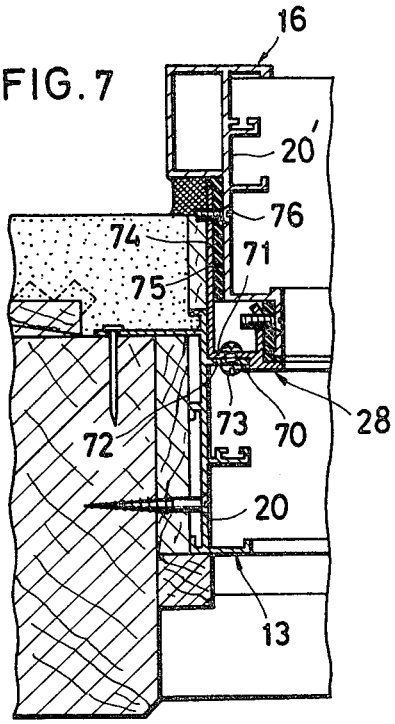

According to a sixth embodiment shown in FIG. 7, the first connector plate 28 has a relatively short base portion 70 and a branch 71 extending outwardly beyond the base portion 70, and the extended branch 71 is secured to an inwardly directed mounting flange 72 of the jamb 20 of the interior window unit 13 by a first set of headed screws 73. The connector plate 28 further has an exteriorly directed mounting fin 74 on and along the outer edge of the branch 71, to which mounting fin the jamb 20′ of the exterior window unit 16 is secured through a sealing strip 75, by a second set of headed screws 76.

Figure 8:
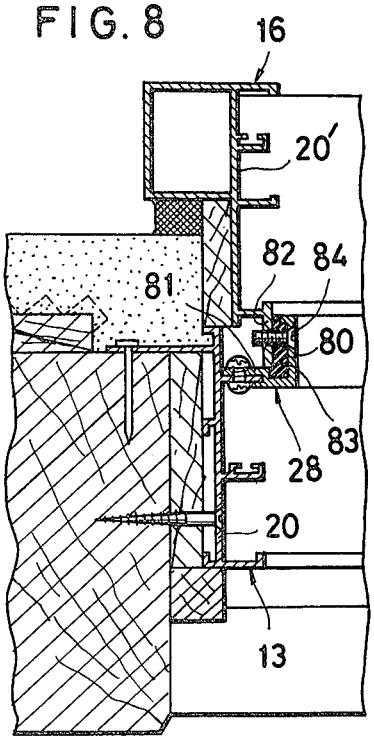

According to a seventh embodiment shown in FIG. 8, an exteriorly directed mounting fin 80 and an engaging branch 81 on the first connector plate 28 are formed separately. The mounting fin 80 is disposed inwardly of an interiorly directed mounting flange 82 of the jamb 20′ of the exterior window unit 16 and is secured thereto through a sealing strip 83 by a number of headed screws 84.

Figure 10:
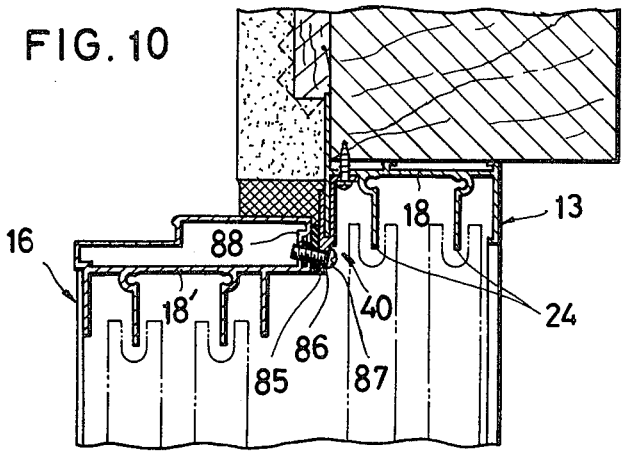
FIGS. 3 through 11 are fragmentary cross-sectional views of several modifications of the assembly, respectively showing modified forms of the connector plate.
Figure 9:
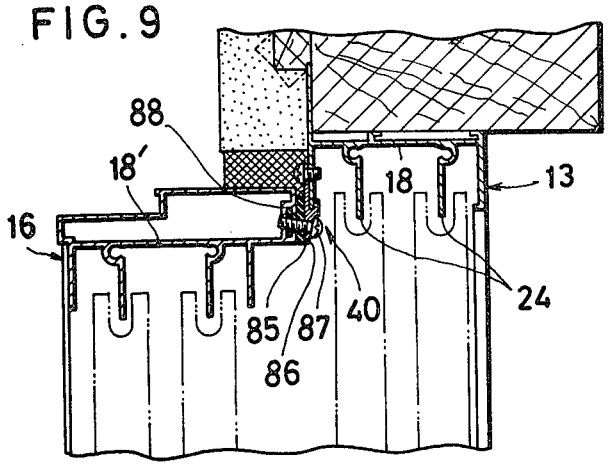

FIGS. 9 and 10, FIG. 10 appearing on Sheet 2, illustrate further modifications of the invention in which the second connector plate 40 has a downwardly tapered base portion 85, as viewed in cross section, of which an interior surface 86 slants so that a number of headed screws 87 each extend obliquely to the upper left (as viewed in FIGS. 9 and 10). With this arrangement, there is no obstruction by a rail or flange 24 on the header 18 of the interior window unit 13, thus facilitating the fastening of the screws 87 in securing the connector plate 40 to a mounting portion 88 of the header 18′ of the exterior window unit 16.

Figure 11:
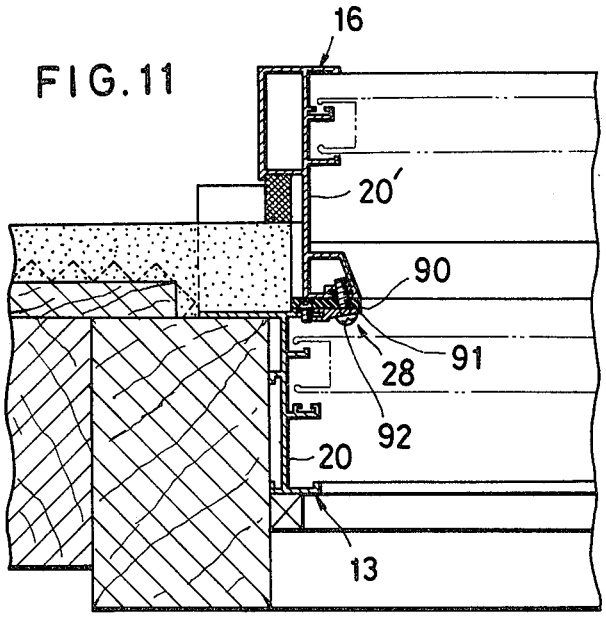

Similarly, as shown in FIG. 11, the first connector plate 28 also may have an inwardly tapered base portion 90, as viewed in cross section, having an interior surface 91 which slants so that a number of headed screws 92 each extend obliquely to the upper left (as viewed in FIG. 11).

Although various minor modifications may be suggested by those versed in the art, it should be understood that I wish to embody within the scope of the patent warranted thereon, all such embodiments as reasonably and properly come within the scope of my contribution to the art.

What is claimed is:

1. A dual window assembly for covering an opening in a building wall having an exterior siding, said dual window assembly comprising in combination:

(a) an interior window unit having a first rectangular unitized metal frame receivable within the opening, and a first pair of sashes mounted within said first frame, said first frame being apertured at its outer periphery for enabling fastening means to project therethrough into the wall, said frame further having a first mounting means composed of vertical flange portions integral with the sides of said first frame at its outer portion for being disposed at the interior side of the exterior siding;

(b) an exterior window unit having a second rectangular unitized metal frame only partially receivable into the wall opening from the exterior, and a second pair of sashes mounted within said second frame, said second frame having a second mounting means composed of first and second flange portions integral with the sides of said second frame at its inner portion and disposed outwardly of said vertical flange portions;

(c) a separate connector plate interconnecting said second frame with said first frame, said connector plate including a pair of first and second sections integral with each other and respectively secured to said first and second mounting means; and (d) engaging means on said second section of said connector plate extending around an edge of said vertical flange portions of said first mounting means.

2. A dual window assembly according to claim 1, said engaging means including a cross-sectionally hook-shaped portion of said first section of said connector plate.

3. A dual window assembly according to claim 2, said second section of said connector plate projecting perpendicularly from said first section and being disposed remote from said hook-shaped portion.

4. A dual window assembly according to claim 3, said second section of said connector plate being disposed inwardly of said second mounting means on said second frame.

5. A dual window assembly according to claim 1 said second section of said connector plate projecting from said first section, said engaging means being a branch extending from said second section coacting with said first section in embracing said first mounting means.

6. A dual window assembly according to claim 5, said first section of said connector plate extends beyond said branch of said second section, and at least one screw passing threadedly through said first mounting means on said first frame and said first section.

7. A dual window assembly according to claim 5, said branch of said second section extending beyond said first section, and at least one first screw passing threadedly through said branch of said second section and said first mounting means on said first frame.

8. A dual window assembly according to claim 7, said second section having an exteriorly extending mounting fin along its outer edge, and at least one screw passing threadedly through said second frame and said mounting fin.

9. A dual window unit according to claim 1, including at least one first screw passing threadedly through said first flange portion, through said mounting means on said second frame and through said first section of said connector plate, and at least one second screw passing threadedly through said second section of said connector plate and said second flange portion of said second mounting means.

10. A dual window assembly according to claim 1, said first and second sections of said connector plate being disposed in a straight line, as viewed in cross section, and said second section having an inwardly tapered portion of which an interior surface slants, said tapered portion having an opening extending at a right angle to said interior surface through which opening a headed screw extends and threadedly engages with said second mounting means.

11. An exterior window unit assembly for covering a building wall opening on the exterior side of the wall's exterior siding, there being mounted within the opening an interior window unit assembly including a first metal frame having a first further mounting flange disposed at the interior side of the exterior siding, said exterior window unit assembly comprising:

(a) a second metal frame for extending beyond the thickness of the exterior siding of the building wall, said second frame having a second mounting flange disposed outwardly of said first mounting flange;

(b) a pair of sashes mounted within said second frame in parallel closely spaced planes;

(c) a separate connector plate for interconnecting said second metal frame with said first metal frame of the interior window unit assembly, said connector plate including a first section for being secured to said first mounting flange, and a second section integral with said first section and secured by a number of screws to said second mounting flange; and (d) engaging means on said connector plate for extending around an edge of said first mounting flange.

* * * * *